United States Patent [19]

Marocco

[11] Patent Number: 4,875,516

[45] Date of Patent: Oct. 24, 1989

[54] VENETIAN BLIND CONTROL

[76] Inventor: Norbert Marocco, 46 Pennygrass Ct., Woodbridge, Ontario, Canada

[21] Appl. No.: 225,148

[22] Filed: Jul. 28, 1988

[30] Foreign Application Priority Data

Feb. 29, 1988 [CA] Canada ..... 560140

[51] Int. Cl.[4] ..... E06B 9/38

[52] U.S. Cl. ..... 160/178.1; 160/177; 160/900; 192/56 R; 464/30

[58] Field of Search ..... 160/176.1, 177, 178.1, 160/900; 192/56 R; 464/30, 37

[56] References Cited

U.S. PATENT DOCUMENTS

| | | | |
|---|---|---|---|
| 2,809,531 | 10/1957 | Moyer | 464/37 X |
| 3,347,062 | 10/1967 | Schumann et al. | 464/37 |
| 3,425,479 | 2/1969 | Lorentzen et al. | 160/176.1 |
| 4,103,727 | 9/1978 | Spohr | 160/176.1 X |
| 4,122,885 | 10/1978 | Marotto | 160/176.1 |
| 4,141,402 | 2/1979 | Marotto | 160/176.1 |
| 4,257,470 | 3/1981 | Woodle | 160/176.1 X |
| 4,267,875 | 5/1981 | Koks | 160/176.1 |
| 4,406,319 | 9/1983 | McNiel et al. | 160/177 |
| 4,607,974 | 8/1986 | Brothers et al. | 160/178.1 X |
| 4,621,673 | 11/1986 | Georgopoulos et al. | 160/176.1 X |
| 4,676,292 | 6/1987 | Valle et al. | 160/176.1 |
| 4,719,955 | 1/1988 | Tachikawa et al. | 160/176.1 X |

*Primary Examiner*—Ramon S. Britts
*Assistant Examiner*—David G. Kolman

[57] ABSTRACT

A clutch assembly for a venetian blind and having a drive member, a driven member, a first engagement device on the drive member, a second engagement device on the drive member, adapted to cooperate to transmit rotation to the blind, and the first and second engagement devices being disengageable in response to over-rotation to discontinue transmission of rotation to the blind. Also disclosed is a connector coupling for connecting between a venetian blind gear drive and a venetian blind wand, and having a pair of resilient fingers, the fingers being received in an opening in a gear drive shaft.

17 Claims, 3 Drawing Sheets

VENETIAN BLIND CONTROL

The invention relates to a slat rotator drive for venetian blinds and in particular to a clutch device for use in such a slat drive system, and also to a connector for such a drive mechanism.

BACKGROUND OF THE INVENTION

Venetian blinds employ horizontal slats, supported on cords. By rotating a shaft in the head of the blind, the cords can be altered in length thus rotating the slats to close or open the blind.

The drive system for driving such a horizontal shaft usually consists of some form of gear drive usually a worm and gear, and a rod or so called "wand" hanging downwardly from the gear drive. The wand can then simply be grasped in the hand and rotated, thereby opening and closing the blind.

For reasons of aesthetics and economy, the mechanism used in such blinds and the cords and the like are relatively small and delicate, and must be handled with a certain degree of care. If for example the wand is rotated too far some damage may be caused.

Such over vigorous rotation may be caused by a careless person, or not infrequently by children playing with the blinds.

In order to overcome this problem, it has been proposed to incorporate a form of clutch mechanism in the gear drive itself.

This is a relatively complex solution to the problem and somewhat increases the cost of the gear drive. The market for blinds is highly competitive and many blind manufacturers do not choose to use the more expensive form of drive. In addition, different blind manufacturers employ various different assemblies and lay outs, and it is not always possible to incorporate a gear system having a clutch in their own particular design.

A further problem relating to the drive system for slat rotators, is the connector between the wand and the drive system.

Generally speaking some form of simple universal coupling connector is provided at the top end of the wand, where it is connected to the gear drive system. This permits the wand to hang down perpendicular, and yet enables a person to swing the wand out, if they should want to, for operation.

Some manufacturers employ a wire loop and sleeve. Others employ a moulded hook at the top of the wand. The use of the wire loop and sleeve involves a minor additional expense, and also requires a certain amount of skill and time during assembly.

The incorporation of a moulded connector on the wand itself is considered a more desirable solution. In the past however, the hooks which have been used have also been a source of problems, since they are liable to break again due to careless handling.

BRIEF SUMMARY OF THE INVENTION

With a view to overcoming these various problems, the invention comprises a clutch assembly for a venetian blind control of the type having a manually operated rotating shaft, and a drive gear assembly, and comprising a drive member adapted to be connected to said control rod, a driven member adapted to be connected to said blind control, first engagement means on said drive member, second engagement means on said driven member, said first and second engagement means being adapted to transmit rotation of said control rod to said blind control, and, releasable means in said first and second engagement means, responsive to over-rotation of said control rod, to discontinue transmission of said rotation to said blind control.

More particularly it is an objective of the invention to provide such a clutch assembly having the foregoing advantages and including a sleeve member defining a hollow interior clutch chamber, abutments formed in said clutch chamber at spaced intervals therearound, means for attaching a first end of said sleeve member to a said drive control rod, a wall portion within said sleeve member having an opening therein, of reduced cross section relative to said hollow interior, gear drive connection means at a second end of said sleeve member, a stub shaft member defining a driven end and a connecting end and a shaft therebetween, portions of said driven end being resilient whereby they may be flexed towards one another, and means formed on said driven end interengageable with said abutment means in said clutch chamber.

More particularly, it is an objective of the invention to provide a clutch assembly having the foregoing advantages and wherein said shaft between said first and second end extends through said opening in said wall portion and being rotatable therein, and being axially slidably moveable relative thereto, and, first locking means on said shaft member, and complementary second locking means on said second end of said sleeve member whereby same may be selectively interengaged by axial movement relative to one another.

More particularly, it is an objective of the invention to provide a clutch assembly having the foregoing advantages wherein said abutments formed in said clutch chamber are in the form of a hexagon in section.

More particularly, it is an objective of the invention to provide a clutch assembly having the foregoing advantages including angled clutch surfaces on said driven end, formed in pairs at angles relative to one another, the angles matching the angles of said hexagonal shape of said clutch chamber.

More particularly, it is an objective of the invention to provide a clutch assembly having the foregoing advantages wherein said driven end of said stub shaft member is formed with an axial slot, dividing the same into two end portions, said end portions being resilient and flexible towards one another.

More particularly, it is an objective of the invention to provide a clutch assembly having the foregoing advantages wherein said driven end has a tapered leading end, and is insertable into said clutch chamber through said opening in said wall.

More particularly, it is an objective of the invention to provide a clutch assembly having the foregoing advantages wherein the length of said shaft between said driven end and said connecting end has a length greater than the thickness of said wall portion whereby to permit axial movement.

It is a further and related objective of the invention to provide a connector for a venetian blind control shaft, for inter-engagement with a drive gear assembly thereof, and wherein said drive gear assembly has a gear shaft extending therefrom, said shaft in turn terminating in a generally flattened drive plate, an opening in said drive plate, channel means formed in said drive plate connecting from an edge of said drive plate to said opening means, a body portion adapted to be attached to an end of said control rod, and a pair of generally semi-circular connection fingers extending from said body portion, said fingers being curved towards one another, and the ends of said fingers being adapted to slide along said channel in said drive plate, and be received in said opening therethrough.

Such a connector, may be incorporated in a clutch assembly of the type described, or may be provided independently of said clutch assembly, for attachment to such a control rod.

The various features of novelty which characterize the invention are pointed out with more particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

IN THE DRAWINGS

Figure 1:
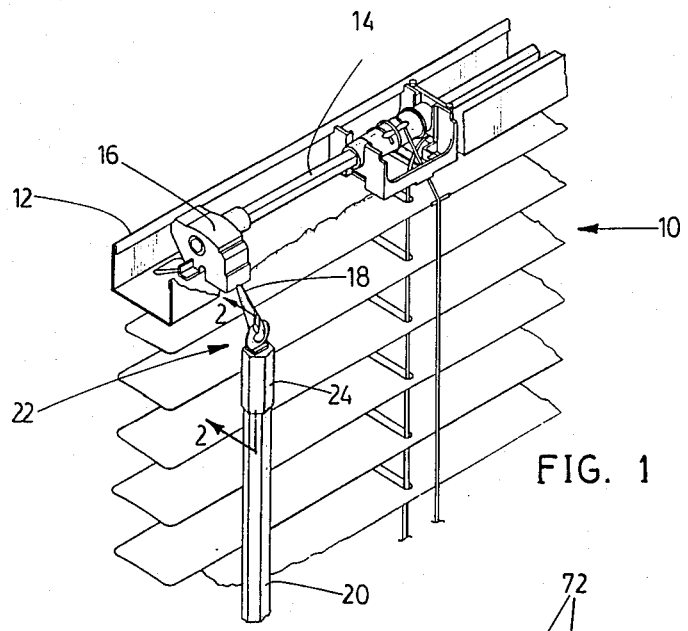
FIG. 1 is a perspective illustration of a portion of a venetian blind, partially cut away to show the location of the gear drive mechanism.

Referring first of all to FIG. 1, it will be seen that what is shown there is exemplary of a typical venetian blind assembly indicated generally as 10. This assembly has typically a channel shaped box 12, adapted to be supported transversely above the window opening (not shown).

Within the channel there is typically located a horizontal control shaft 14. Rotation of the control shaft in one direction or the other will cause the blind slats to open and close in a well known manner.

Typical examples of venetian blind assemblies are shown in U.S. Pat. No. 4,487,243.

Typically, the horizontal shaft 14 will be rotated to and fro through a worm and gear assembly indicated as 16, the details of which are omitted for the sake of clarity.

The gear assembly 16 is typically received in the channel 12, and has a gear drive shaft 18 extending outwardly at an angle from the channel.

In order to operate the gear drive shaft 18, a rod or "wand" 20 is connected to the gear drive shaft 18, by means of a swingable coupling indicated generally as 22, the details of which will be described below.

Between the swingable coupling 22, and the wand 20, there is provided in accordance with the invention, a clutch assembly indicated generally as 24.

As explained above the purpose of the clutch assembly 24 is to respond to over rotation of the wand 22, and to avoid transmitting over rotation of the wand to the gear assembly.

Referring now to FIGS. 2, 3, 4, and 5, it will be seen that the clutch assembly 24, in accordance with the invention, is illustrated in this embodiment in the form of a drive member or sleeve 30, having a drive end 32, and a wand connection end 34.

Figure 3:
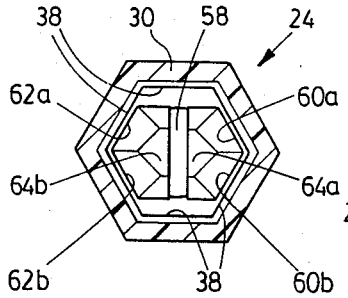
FIG. 3 is a section along the line 3—3 of FIG. 2.

Within the member 30, there is defined a clutch chamber indicated generally as 36. Clutch chamber 36 is provided with a series of first engagement means in the form of abutments on its inner surface indicated as 38. In this embodiment, such abutments are in the form of six surfaces forming a hexagonal shape in section (FIG. 3). The surfaces 38 will thus meet at obtuse angles as shown.

However, the invention is not limited to six flat surfaces, but comprehends abutments of a wide variety of different forms providing the function to be described below.

Between the chamber 36 and the end 34, there is defined a wand recess 40, which is shaped and adapted to receive the end of the wand. Wands are frequently given a hexagonal shape in section and accordingly, in this embodiment, the recess 40 is formed to complement such a shape. Typically the wand will be inserted into the recess 40 and retained therein by suitable adhesive.

In some cases, it may be desirable to give the customer the option of overriding the clutch. This may be desirable if, for example, the customer feels that a slight over-rotation will produce a better closure of the blind slats.

For this purpose, the drive end of the sleeve 30 is formed in this embodiment with first override means, which in this particular case is shown as a recess 42 of generally square shape in section. It will however be appreciated that the override means will not necessarily be in the form of a recess but may equally well be in the form of other formations, having the function described below.

Between the override means 42 and the clutch chamber 36 there is provided a wall portion 44, defining a through passageway 46 therein.

The clutch assembly 24 in this embodiment further includes a driven member indicated generally as 50. The driven member 50 has a driven end 52, and a connection end 54, and an intermediate shaft portion 56 extending therebetween.

The driven end 52 is shaped and adapted to be received in the clutch chamber 36. For this purpose, it is provided with generally resilient means, in this case in the form of the slot 58, defining two driven end portions 52*a* and 52*b*. The material from which the stub shaft 50 is formed will typically be injection moulded plastic having suitable resilient characteritics.

Figure 2:
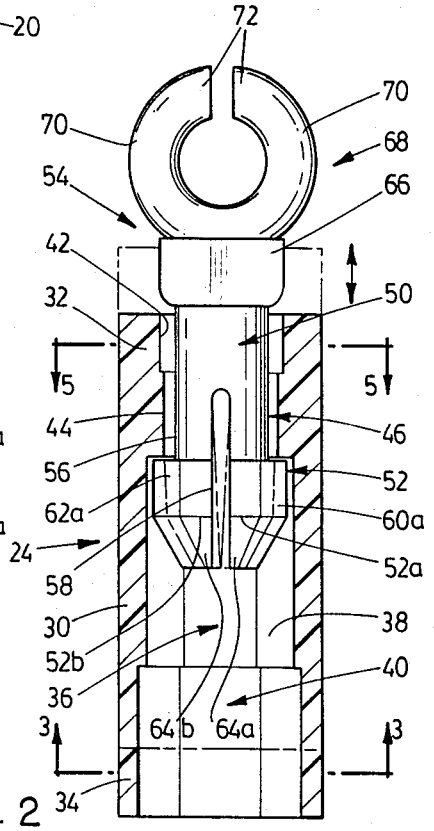
FIG. 2 is an enlarged sectional side elevation view of the clutch assembly, along the line 2—2 of FIG. 1.

In this way, the two portions 52*a* and 52*b* may be flexed towards one another and will spring apart when released, as shown in phantom in FIG. 2.

The invention is not however limited to such a particular form of resilient means, but comprehends other means which may achieve the same result.

On the two end portions 52*a* and 52*b*, there are formed two pairs of second engagement means in the form of clutch surfaces 60*a*, 60*b*, 62*a* and 62*b*. These surfaces are angled generally planar surfaces, in this case, adapted to cooperate with the first engagement surfaces 38. Thus typically the pairs of angled surfaces 60*a* or 60*b* will be at an obtuse angle to one another corresponding to surface 38.

Figure 4:
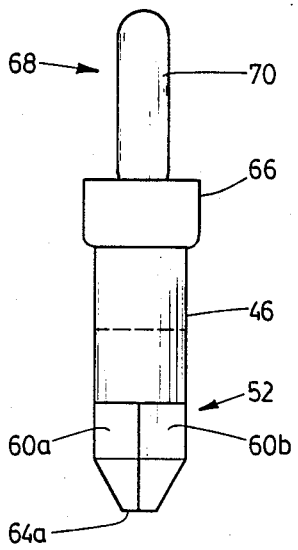
FIG. 4 is a side elevation of a portion of the clutch assembly.
Figure 5:
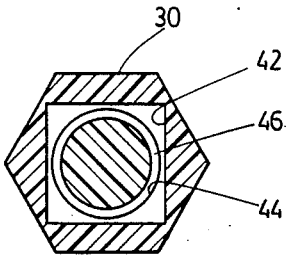
FIG. 5 is a top plan view of a portion of the drive clutch assembly.

Between the pair of surfaces 60*a*, 60*b* and 62*a*, 62*b*, the driven end 52 is of reduced width (FIGS. 3 and 4). In this way, when the two portions 52*a*, 52*b* flex together, the end 52 can remain stationary within clutch member 36 while the chamber rotates.

When the two portions 52*a*, 52*b* are in their working position, as shown in FIG. 2, however the surfaces 60 and 62 will normally be in contact with the surfaces 38 of the clutch chamber, and will transmit rotation of the clutch member to the gear drive shaft 18.

When the gear drive shaft 18 will no longer rotate, because the blind slats have been rotated as far as they will go, then continued rotation will cause the two portions 52*a*, 52*b* to flex together, thereby permitting the clutch chamber to rotate around the two end portions 52*a*, 52*b*.

The end portions 52*a*, 52*b* are also formed with tapered leading ends 64*a*, 64*b* to facilitate assembly.

It will be appreciated however the invention is not limited specifically to angled clutch surfaces but comprehends other such means having the function described below.

The shaft 56 in this embodiment is of cylindrical shape, and is adapted to be received in the opening 46 of wall portion 44.

On the connection end 54, the member 50 is provided with a second override means in the shape of a rectangular block, having rounded shoulders, and indicated generally as 66, and shaped to interengage and cooperate with the first override means 42 of the sleeve 24.

Extending from the block 66, is a coupling device 68, for interengagement with the gear drive shaft 18.

Various different forms of coupling devices may be employed such as are well known in the art.

In this particular embodiment however the coupling device 68 is in the form of a pair of fingers 70, to be described below.

It will be noted that the opening 46 defines an axial length which is less than the length of the shaft portion 56, so that in this way the shaft portion 56 can be moved axially relative to the wall 44.

The difference in length is such that the first and second override means when disengaged, may be maintained out of connection so that the first override means may rotate relative to the second override means. In the embodiment, as shown, this spacing would be approximately equal to the length of the first override means 42.

Dealing first of all with the operation of the clutch assembly 24, during normal operation, the clutch surfaces 60 and 62 will make a snug fit against the surfaces 38 in the clutch chamber 36. Due to the resilience of the portions 52*a* and 52*b*, this engagement will be maintained during normal rotation of the wand.

Once however the horizontal shaft 14 has reached the limit of its rotation in one direction if the wand is then over-rotated, by the application of greater rotational force, then the resilience of the portions 52*a*, 52*b* will permit them to be squeezed together thereby allowing the surfaces 60*a*, 60*b* and 62*a*, 62*b* to slip past the surfaces 38 in the clutch chamber 36.

In this way, the wand, and the sleeve portion 30 of the clutch assembly 24, can be rotated continuously, without causing damage to the gear assembly or the remainder of the blind.

In the event, however, that for some reason the blind does not close as tightly as is wished, and a slight degree of further rotation will achieve this complete closure then a person operating the wand can override the effect of the clutch, by causing the two override means 42 and 66 to interengage and form a transmission lock.

This is achieved simply by pushing the wand towards the gear assembly. This will then simply cause the override means 66 and 42 to slide into engagement.

A slight further turn on the wand will then usually produce the necessary closure of the blind slats.

As soon as the wand is released, the weight of the wand will cause disengagement of the override means 42 and 66.

In the event that a child is playing with the blind, then normally the child will simply rotate the wand, without pushing it upwardly.

Such rotation of the wand will not in that case cause harm to the blind.

As mentioned, the override means is shown simply as a square-shaped recess 42, and a corresponding block 66.

Figure 6:
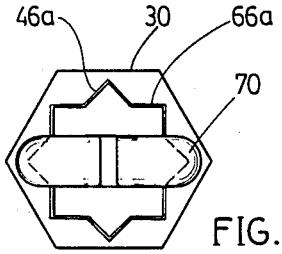
FIG. 6 is a top plan view of an alternate embodiment of clutch assembly.

Other means achieving this function can also be used. For example, as shown in FIG. 6, such override means could be in the form of a plurality of star shaped teeth 66*a*, fitting in a recess 46*a* of corresponding shape.

Figure 7:
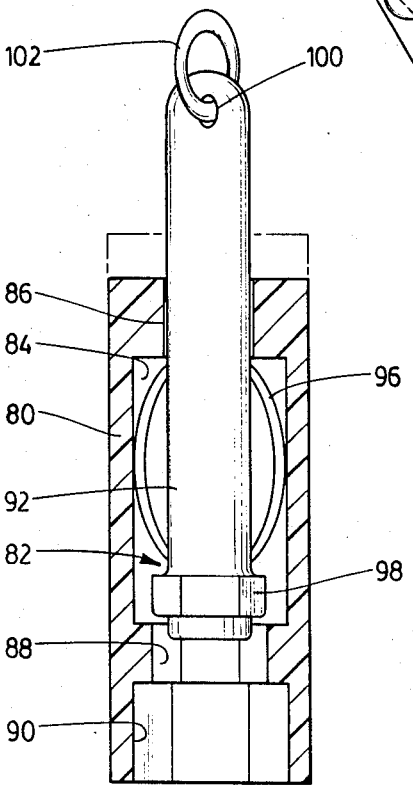
FIG. 7 is a sectional side elevation view of a further alternate embodiment of clutch assembly.
Figure 9:
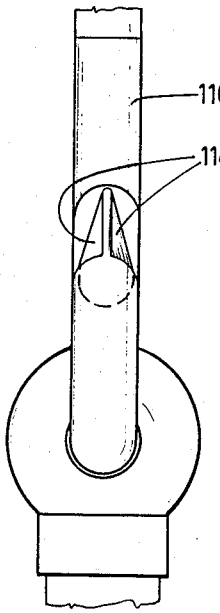
FIG. 9 is a side elevation of a portion of FIG. 8 rotated 90 degrees.
Figure 10:
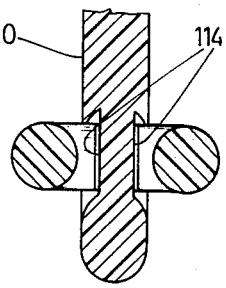
FIG. 10 is a section along line 10—10 of FIG. 9.
Figure 8:
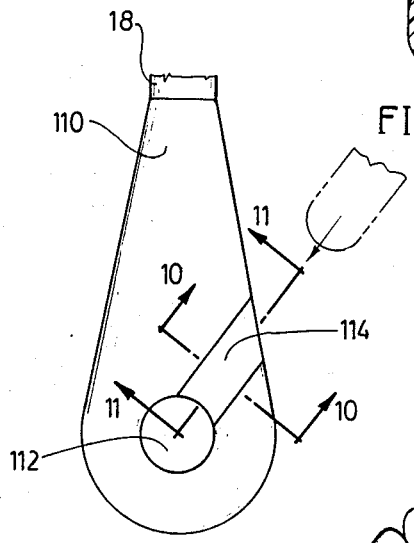
FIG. 8 is a side elevation of the connection between the clutch assembly and the gear mechanism.

It will also be appreciated that the arrangement of the sleeve and driven member in the clutch assembly can be reversed. Thus, as shown in FIG. 7, a modified form of sleeve 80 may have a clutch chamber 82 with first engagement surfaces 84, and having a wall 86 at its upper end with an opening.

The first override means, indicated generally as 88, would be located below the clutch chamber 82, followed by the wand recess 90.

The driven member 92 would have second engagement surfaces in the form of on resilient rib portions 96, and second override means 98 interengageable with the first override means 88 by a telescopic sliding action as before.

The upper end of the driven member would have a connection opening 100 formed therethrough, for interconnection with the gear drive shaft 18 by any known means such as a wire loop 102.

This embodiment of the invention might have desirable qualities for some customers who were not willing to change the form of their gear drive assembly, but wanted to take advantage of the clutch assembly and override features.

As noted above, the invention also provides a coupling or connector means for coupling to the gear shaft 18. This is shown in more detail in FIGS. 8, 9, 10 and 11.

It will be noted that in this embodiment the gear assembly 16, the drive shaft 18 will be seen to have a flattened drive plate portion 110 having opposed side surfaces. An opening 112 is formed through the plate 110. Two channels 114 are formed in the plate 110, on opposite side surfaces, and in registration with one another. Channels 114 connect from the outside edge of the plate 110 to the opening 112.

In the operation of the connection means, the wand and clutch assembly 70 is swung around until the end portions 72 of the fingers 70 register in the channels 114. The two ends 72 can then be slid along the channels 114, until they reach the opening 112.

At this point, the wand can then simply be swung downwardly, and the two fingers 66 will be locked in place.

Figure 11:
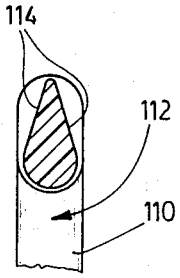
FIG. 11 is a section along line 11—11 of FIG. 8.

The surfaces of the channels 114 define a ramp or wedgelike shape along their length (FIG. 11). In this way, the fingers 70 are progressively forced further and further apart as they are moved along the channels, until they register with the opening at which point they spring back together, securely engaging in the opening.

Figure 12:
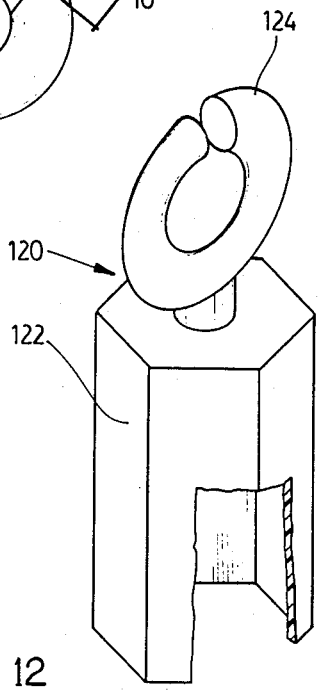
FIG. 12 is a perspective illustration of an alternate embodiment of wand connector.

As noted above, this form of coupling or connector can be used with or without the clutch assembly. If, for example, a manufacturer wishes to make use of this form of coupling but does not wish to go to the additional expense of a clutch assembly, then, as shown in FIG. 12, a wand connector indicated generally as 120 may be provided. This consists simply of a socket or sleeve 122, having fingers 124 thereon similar to fingers 70.

The end of the wand can simply be inserted into the sleeve and fastened by adhesive. The wand can then be connected to the gear drive assembly in the manner described above.

This form of engagement has considerable advantages over a single hook, since the rotational force is taken by two fingers 70 instead of by a single hook.

Consequently there is less likelihood of damage.

The foregoing is a description of a preferred embodiment of the invention which is given here by way of example only. The invention is not to be taken as limited to any of the specific features as described, but comprehends all such variations thereof as come within the scope of the appended claims.

What is claimed is:

1. A clutch assembly for use in association with a venetian blind of the type having a blind control and a control rod for operating said control and swingable joint means interconnecting said control rod and said blind control, said clutch assembly comprising:

a drive member adapted to be connected to said control rod;

a driven member adapted to be connected to said swingable joint means;

first engagement means on said drive member;

second engagement means on said driven member, said first and second engagement means being adapted to cooperate to transmit rotation of said control rod to said swingable joint means, and, releaseable means in one of said first and second engagement means responsive to over-rotation of said control rod to discontinue transmission of said rotation to said swingable joint means.

2. A clutch assembly as claimed in claim 1 wherein said drive member and driven member are axially slideably moveable along the axis of said control rod towards and away from one another.

3. A clutch assembly as claimed in claim 2 including complementary release override means on said drive member and on said driven member, said override means being normally disengaged, and being engageable by relative axial sliding movement of said drive member and said driven member along the axis of said control rod.

4. A clutch assembly as claimed in claim 1 wherein said drive member comprises a generally hollow sleeve, abutments formed within said sleeve, and wherein said driven member is adapted to contact said abutments, for transmission, said driven member being adapted to respond to over-rotation of said control rod to move relative to said abutments.

5. A clutch assembly as claimed in claim 4 wherein said driven member is formed with two drive portions, said drive portions being resilient and being moveable towards and away from one another.

6. A clutch assembly for a venetian blind control of the type having rotatable slats, a drive gear assembly for rotating said slats, and a control rod for operating said drive gear assembly and comprising:

a sleeve member defining a hollow interior clutch chamber;

abutments formed in said clutch chamber at spaced intervals therearound;

means for connecting a first end of said sleeve member to said control rod;

a wall portion within said sleeve member having an opening therein of reduced cross section relative to said hollow interior;

a stub shaft member defining a driven end and a connecting end and a shaft therebetween, shaft portions of said driven end received in said clutch chamber being adapted to be flexed towards one another and said connecting end being adapted to be connected to said drive gear assembly; and, means formed on said driven end of said stub shaft member interengagable with said abutment means in said clutch chamber.

7. A clutch assembly as claimed in claim 6 wherein said shaft between said first and second end extends through said opening in said wall portion and is rotatable therein, and is axially slidably moveable relative thereto, and first override means on said shaft member, and complementary second override means on said second end of said sleeve member, said first and second override means defining complementary interengageable drive transmission means whereby same may be selectively interengaged by axial movement relative to one another.

8. A clutch assembly as claimed in claim 6 wherein said abutment means formed in said clutch chamber are in the form of surfaces forming a hexagon in section.

9. A clutch assembly as claimed in claim 8 including angled clutch surfaces on said driven end, formed in pairs at angles relative to one another, the angles matching the angles of said hexagonal shape of said clutch chamber.

10. A clutch assembly as claimed in claim 6 wherein said driven end of said stub shaft member is formed with an axial slot, dividing the same into two end portion, said end portions being resilient and flexible towards one another.

11. A clutch assembly as claimed in claim 6 wherein said driven end has a tapered leading end, and is insertable into said clutch chamber through said opening in said wall.

12. A clutch assembly as claimed in claim 6 wherein the length of said shaft between said driven end and said connecting end has a length greater than the thickness of said wall portion whereby to permit axial movement.

13. A connector for a venetian blind control rod, for interengagement with a drive gear assembly thereof, and wherein said drive gear assembly has a gear shaft extending therefrom, and comprising:

a generally flattened drive plate formed on said gear shaft and defining two sides;

opening means formed in said drive plate;

channel means formed in both said sides of said drive plate connecting from an edge of said drive plate to said opening means, and, a pair of generally semi-circular connection fingers extending from said control rod, said fingers being curved towards one another, and the ends of said fingers being adapted to slide along said channel means in said both sides of said drive plate, and to be received in said opening means therein.

14. A connector for a venetian blind as claimed in claim 13, wherein said gear shaft and drive plate define a longtitudinal rotational axis, and wherein said channel means is formed at an obtuse angle to said axis.

15. A connector for a venetian blind as claimed in claim 13 including wedge surfaces formed on the ends of said connection fingers.

16. A connector for a venetian blind as claimed in claim 13 and including a body portion adapted to be connected to an end of said control rod, said fingers being formed integrally with said body portion.

17. A clutch assembly as claimed in claim 3 wherein said release override means comprise a recess on one of said drive member and said driven member, said recess defining a predetermined non-circular shape in section, and a block member on the other of said drive member and said driven member, said block member being shaped to be removeably received in said recess, said recess and said block member being normally disengaged from one another, and being engageable upon relative axial sliding movement to override said releaseable means.

* * * * *